US007705545B2

(12) United States Patent
Versluijs et al.

(10) Patent No.: US 7,705,545 B2
(45) Date of Patent: Apr. 27, 2010

(54) BACKLIGHT UNIT

(75) Inventors: Cornelis Versluijs, Eindhoven (NL); Marialuce Graziadei, Amsterdam (NL); Renatus Willem Clemens Van Der Veeken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 187 days.

(21) Appl. No.: 12/091,096

(22) PCT Filed: Oct. 20, 2006

(86) PCT No.: PCT/IB2006/053866

§ 371 (c)(1), (2), (4) Date: Apr. 22, 2008

(87) PCT Pub. No.: WO2007/049202

PCT Pub. Date: May 3, 2007

(65) Prior Publication Data

US 2008/0224620 A1 Sep. 18, 2008

(30) Foreign Application Priority Data

Oct. 25, 2005 (EP) ..... 05109971

(51) Int. Cl.
*H05B 37/02* (2006.01)

(52) U.S. Cl. ..... 315/291; 315/307; 315/308

(58) Field of Classification Search ..... 315/169.1, 315/291, 307, 308, 246, DIG. 5, DIG. 7, 315/DIG. 2
See application file for complete search history.

(56) References Cited

U.S. PATENT DOCUMENTS

| | | | | |
|---|---|---|---|---|
| 6,326,738 | B1 | 12/2001 | McAndrew | |
| 7,126,286 | B2 * | 10/2006 | Yoo et al. | 315/219 |
| 7,332,867 | B2 * | 2/2008 | Cho | 315/209 R |
| 7,402,962 | B1 * | 7/2008 | Fong | 315/299 |
| 2003/0063050 | A1 | 4/2003 | Tomida et al. | |
| 2003/0090455 | A1 | 5/2003 | Daly | |
| 2004/0233663 | A1 | 11/2004 | Emslie et al. | |

FOREIGN PATENT DOCUMENTS

WO WO9925001 A1 5/1999

* cited by examiner

*Primary Examiner*—David Hung Vu

(57) ABSTRACT

Backlight unit comprising a supply source (4), a discharge lamp (2) having a tubular discharge vessel (6) with an ionizable filling, three or more electrodes (8, 10, 12) arranged in a row along and external of the vessel at spaced relation to each other. The supply source comprises lamp drivers (14, 16) and data processing means (18). Each pair of different pairs of electrodes is coupled to a corresponding lamp driver. Each lamp driver is suitable to supply a high frequency supply voltage to the pair of electrodes to which the lamp driver is coupled. The data processing means is suitable to process input display data (D) and to control the lamp drivers such that their supplied supply voltages are dependent on the input display data.

6 Claims, 1 Drawing Sheet

BACKLIGHT UNIT

FIELD OF THE INVENTION

The invention relates to a backlight unit as described in the preamble of claim 1. In particular, the backlight unit is for use in a liquid crystal display (LCD) device.

BACKGROUND OF THE INVENTION

A backlight unit of the above type is disclosed by WO99/25001. The prior art backlight unit comprises a single lamp, which is bent to follow a serpentine path. There are three electrodes provided external to the lamp: one outer electrode at each extremity of the lamp and one center electrode in the middle between the outer electrodes. A supply source generates a high frequency supply voltage which is supplied to a primary winding of a transformer. The transformer has two secondary windings with two outer terminals and one common center terminal. Each secondary winding is connected to a different pair of an outer electrode and the center electrode, such, that the electrodes at the extremities of the lamp have opposite phases. Accordingly, the supply source provides lamp drivers for driving different pairs of electrodes in one manner. A goal thereof is to provide a uniform brightness distribution of light emitted by the lamp.

OBJECT OF THE INVENTION

An object of the invention is to extend the possibilities for use of a backlight unit of the above type.

SUMMARY OF THE INVENTION

The above object of the invention is achieved by providing a backlight unit as described in claim 1.

Accordingly, the pairs of electrodes divide the lamp into sections which can be supplied by different supply voltages, which are dependent on input display data, so that a display by a display device comprising the backlight unit can be altered by changing the amount of emitted light locally as well, that is, apart from individual controlling pixels of a display panel of the display device by the input display data. By changing the amount of emitted light locally a contrast between certain areas of the display can be increased. This may be particular advantageous when using a LCD panel and/or when the display contains an important message.

BRIEF DESCRIPTION OF THE DRAWINGS

The invention will become more gradually apparent from the following exemplary description in connection with the accompanying drawing. In the drawing.

DETAILED DESCRIPTION OF EXAMPLES

Figure 1:
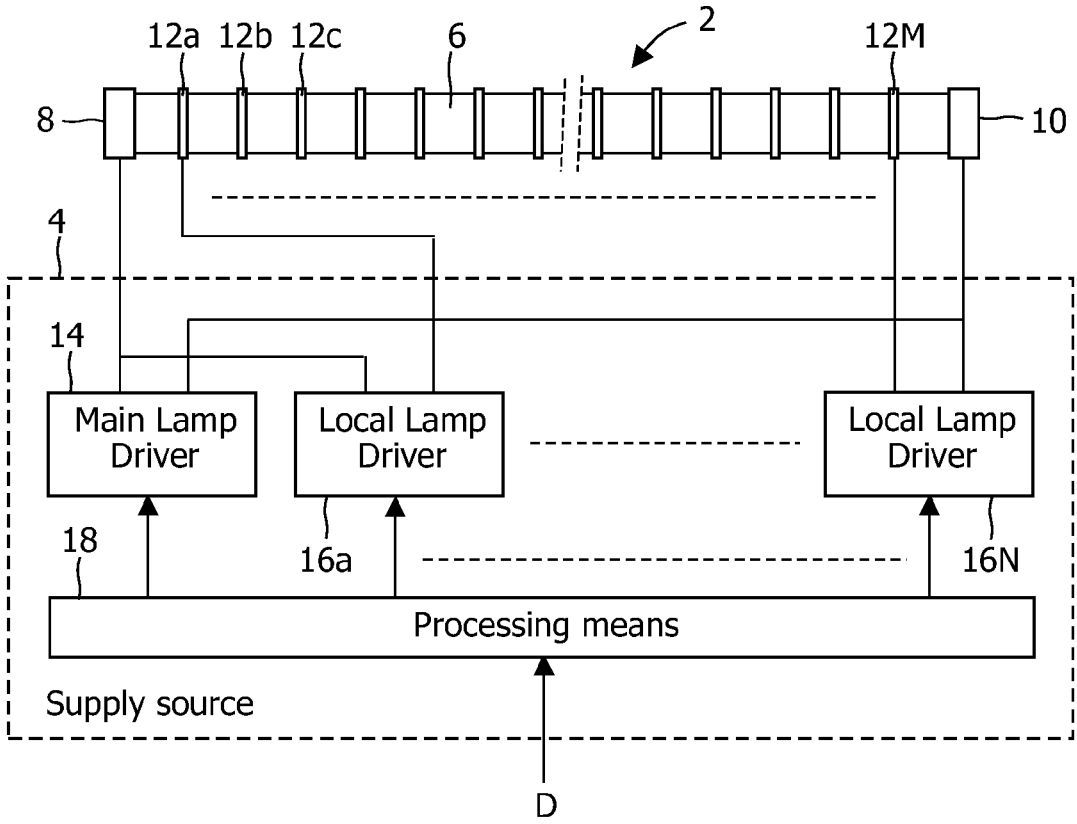
FIG. 1 shows a diagram of an electrical circuit of an embodiment of the backlight unit according to the invention.

The diagram of an electrical circuit of a backlight unit according to the invention shown in FIG. 1, comprises basically a tubular gas discharge lamp 2 and a supply source 4. The lamp 2 comprises a vessel 6 which contains an ionizable filling and an luminescent layer at its inner surface. At two different locations, in particular at the extremities of the vessel 6, the lamp 2 has external electrodes 8 and 10. These electrodes 8, 10 are called extremity electrodes in here. The extremity electrodes 8, 10 are connected to the supply source 4. The supply source 4 is suitable to generate and to supply an alternating supply voltage of, for example 200 Vrms and 2.65 MHz. Dependent on regional requirements other values may be used, such as a frequency of 13.56 MHz. The filling of the vessel 6 is such that it is ionized if the supply source 4 supplies said supply voltage to the extremity electrodes 8, 10. For example, the filling is a mixture of argon and mercury. If ionized, the filling is electrically conducting via an arc between the electrodes 8, 10. The luminescent layer will be activated then, so that the lamp 2 will emit light.

Between the extremity electrodes 8, 10 the lamp 2 is provided with M additional external electrodes 12*a*, 12*b*, 12*c*, . . . , 12M (12 in general), called intermediate electrodes in here (by "intermediate" "somewhere between neighboring electrodes" is meant here). In the drawing of FIG. 1 the electrodes 8, 10, 12 are spaced equally. However, different spaces between the electrodes 8, 10, 12 are allowed as well.

The supply source 4 has a main lamp driver 14, which is connected to the extremity electrodes 8, 10.

Further, the supply source 4 has N=M+1 local lamp drivers 16*a*, 16*b*, 16*c*, . . . , 16N (16 in general), which are connected individually to the intermediate electrodes 12*a*, 12*b*, 12*c*, . . . , 12M, respectively, and in series to the extremity electrodes 8, 10.

Figure 2:
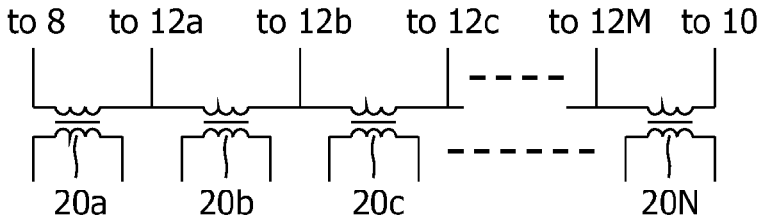
FIG. 2 shows a diagram of an example part of the circuit of FIG. 1.

In addition, the supply source has processing means 18, which is supplied with display data D from a data source (not shown), such as an external computer system. The lamp drivers 14, 16 are connected to the processing means 18. The processing means 18 controls the lamp drivers 14, 16 to let each of them generate a supply voltage of which at least one property, for example its magnitude, is made dependent on the input display data D. The lamp drivers 14, 16 supply their supply voltages to the electrodes 8, 10, 12 connected therewith. Accordingly, different voltages may be applied to the electrodes 8, 10, 12, so that different voltage potentials may occur between neighboring electrodes, that is, between electrode pairs 8 and 12*a*; 12*a* and 12*b*; 12*b* and 12*c*; . . . ; 12M and 10. As a result, different light intensities may occur between those pairs of electrodes dependent on the input display data D. In other words, by providing suitable display data D the data source has full control over a brightness distribution along the lamp 2. This may be advantageous for several reasons. One of said reasons may be that it allows to compensate for not-uniform brightness distribution of the lamp 2 as it is. A more important reason is that it allows to emphasize areas of a display (text and/or graphics) with respect to other areas, in particular surrounding areas, on a display screen of the display device comprising the backlight unit. This may be the case if one wants to emphasize a displayed warning message. In addition, it is very useful to improve a contrast property of a liquid crystal display (LCD) device, as it is known that a LCD panel of such a device provides a poor contrast ratio itself. For example, when applying the backlight unit according to the invention to such a LCD device, for a dark display area one may minimize the supply voltage supplied to a pair (or to pairs) of electrodes 8, 10, 12 of which a lamp section in between covers said dark area to completely blacken said area. FIG. 2 shows a circuit diagram of a part of the supply source 4 of FIG. 1. In particular, FIG. 2 shows a row of N=M+1 transformers 20*a*, 20*b*, 20*c*, . . . , 20N (20 in general), which are each a component of a local lamp driver 16*a*, 16*b*, 16*c*, . . . , 16N, respectively. The secondary windings of the transformers 20 are connected in series to the extremity electrodes 8, 10. Connection nodes between each pair of connected secondary windings of the transformers 20 are connected to the intermediate electrodes 12*a*, 12*b*, 12*c*, . . . , 12M, respectively. The primary windings of the transformers 20*a*, 20*b*, 20*c*, . . . , 20N are supplied by an alternating voltage which is generated by the local lamp drivers 16*a*, 16*b*, 16, . . . , 16N, respectively, under control of the processing means 18. By applying the configuration of FIG. 2 the burden of using voltage level shifters in the local lamp drivers 16 is avoided.

Figure 3:
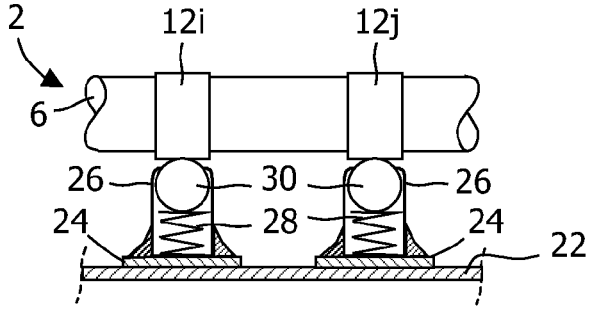
FIG. 3 shows a perspective view of a part of an embodiment of the backlight unit, showing means to couple the lamp of FIG. 1.

FIG. 3 shows a diagram of a part of a mechanical construction of the backlight unit according to the invention. FIG. 3 shows, in cross section, a printed circuit board (PCB) 22. On a surface of the PCB 22 an electrically conducting wiring 24 is provided. On specific parts of the wiring 24 a number of tubular connection studs 26 are soldered. Each stud 26 contains a spring 28 and a ball 30. The spring 28 and the ball 30 are electrically conducting. The spring 28 forces the ball 30 against an electrode 8, 10, 12 of the lamp 2. Displacement of the ball 30 towards the lamp 2 is limited by an inwardly bent edge part of the stud 26. By applying such a configuration, the lamp 2 can easily be installed, electrical connections between the PCB 22 can be made easily, so that it is possible to arrange, to electrically connect and to drive a large number of intermediate electrodes 12.

Preferably, at the side where the lamp 2 is arranged, the PCB 22 is provided with a light reflective layer (not shown), which may take over a reflection property of an inner surface of a back wall of a usual box containing a backlight unit. In fact, the PCB 22 may carry the supply source 4 and it may even make said usual box unnecessary.

It is noted that the invention is not limited to the illustrated embodiment but only by the following claims. For example, the backlight unit may comprise any number of lamps 2, with each lamp 2 having its own external electrodes 8, 10, 12 which are coupled to corresponding lamp drivers 14, 16 for said lamp 2. Also, instead of using studs 26 containing spring loaded balls 30 other flexible contacting means, such as flexible tongues can be used. Also, a flexible PCB 22 can be used which is bent to and from the electrodes 8, 10, 12 to contact the electrodes directly.

The invention claimed is:

1. A backlight unit, comprising a supply source (4), a discharge lamp (2) having a tubular discharge vessel (6) with an ionizable filling, electrodes (8, 12*a*, . . . 12M, 10) arranged in a row along and external of the vessel at spaced relation to each other, wherein the supply source comprises lamp drivers (14, 16*a*, . . . 16N), each of different pairs of electrodes is coupled to a corresponding lamp driver, and each lamp driver is suitable to supply a high frequency supply voltage to the pair of electrodes to which the lamp driver is coupled, characterized in that the supply source (4) comprises data processing means (18), which is suitable to process input display data (D) and to control the lamp drivers (14, 16*a*, . . . 16N), such that their supplied supply voltages are dependent on the input display data.

2. Backlight unit according to claim 1, characterized in that, each of the lamp drivers coupled to electrodes (12) other than electrodes (8, 10) at the ends of the row of electrodes comprises a transformer (20), and the secondary windings of the transformers are connected in series to the electrodes (8, 10) at the ends of the row of electrodes.

3. Backlight unit according to claim 1, characterized in that, a printed circuit board (22) is provided, the lamp is arranged in parallel to the board, and the electrodes and lamp drivers are connected electrically to a wiring (24) provided on the board.

4. Backlight unit according to claim 3, characterized in that, the electrodes are connected electrically to the wiring by resilient contact means (26, 28, 30).

5. Backlight unit according to claim 3, characterized in that, at a side of the board where the lamp is arranged, the board is provided with a light reflective layer.

6. Backlight unit according to claim 1, characterized in that, the processing means (18) is connected to more than one set of a gas discharge lamp (2) having external electrodes (8, 10, 12*a*, . . . 12M) and lamp drivers (14, 16*a*, . . . 16N) connected therewith.

* * * * *